US005862928A

United States Patent [19]

Breuer et al.

[11] Patent Number: 5,862,928

[45] Date of Patent: Jan. 26, 1999

[54] CLOSURE FOR A BOTTLE OR THE LIKE

[75] Inventors: Hans-Werner Breuer, Laufen, Switzerland; Michael Hertrampf, Gehrden, Germany

[73] Assignee: Safety Cap System Ag, Switzerland

[21] Appl. No.: 817,357

[22] PCT Filed: Sep. 22, 1995

[86] PCT No.: PCT/EP95/03746

§ 371 Date: Jun. 25, 1997

§ 102(e) Date: Jun. 25, 1997

[87] PCT Pub. No.: WO96/11148

PCT Pub. Date: Apr. 18, 1996

[30] Foreign Application Priority Data

Oct. 11, 1994 [DE] Germany ..... 44361505

[51] Int. Cl.[6] ..... B65D 53/00

[52] U.S. Cl. ..... 215/350; 215/341

[58] Field of Search ..... 215/341, 348, 215/349, 350, 351

[56] References Cited

U.S. PATENT DOCUMENTS

| | | | |
|---|---|---|---|
| 3,174,641 | 3/1965 | Kitterman et al. . | |
| 3,520,436 | 7/1970 | Vercillo | 215/348 |
| 3,868,038 | 2/1975 | Hadley | 215/305 |
| 3,883,025 | 5/1975 | Jemmett | 215/341 |
| 4,128,184 | 12/1978 | Northup | 215/222 |
| 4,407,422 | 10/1983 | Wilde et al. . | |
| 4,664,280 | 5/1987 | Whitney et al. | 215/350 |
| 4,879,138 | 11/1989 | Johnson et al. | 215/348 X |

FOREIGN PATENT DOCUMENTS

| | | |
|---|---|---|
| 546399 | 4/1956 | Belgium . |
| 0 263 699 | 4/1988 | European Pat. Off. . |
| 0 581 568 A1 | 2/1994 | European Pat. Off. . |
| 93 15 492 U | 2/1994 | Germany . |
| 42 34 010 A1 | 4/1994 | Germany . |

*Primary Examiner*—Stephen K. Cronin
*Attorney, Agent, or Firm*—Olson & Hierl, Ltd.

[57] ABSTRACT

A closure for the bottle having a cap-like closure part with an inward projection at its edge for clasping an outward projection on the neck of the bottle or the like. In the area of the face edge of the bottle neck the interior of the closure has a sealing surface for seating on the end face of a bottle neck. The sealing surface (5) has a sealing surface part (8) which is formed on the radial inner side of a projection directed away from the base of the closure part axially and clasping around the bottle neck and which is sloped radially toward the interior and axially counter to the screwing direction. The sloping sealing surface part (8) ensures the centering of the seal, improves the sealing effect, and contributes to the opening of the overpressure valve thereby formed, the opening pressure of which can be influenced through the selection of the degree of slope of the sealing surface part (8).

8 Claims, 1 Drawing Sheet

CLOSURE FOR A BOTTLE OR THE LIKE

BACKGROUND OF THE INVENTION

1. Field of the Invention

The invention concerns a closure, for a bottle or the like.

2. Description of Related Art

A closure for a bottle or the like is known from DE 42 34 010 A1 which has a cap-like closure part having a backward-facing projection on its edge for clasping an outward-directed projection on the neck of a bottle or the like and which has a sealing surface on its interior in the area of the edge of the face of the neck of the bottle. This sealing surface is situated on a seal, arranged at the base area of the closure part, which has a recess on the side directed toward the base of the cap-like closure part. This recess extends from a radial area on the inside of the contact surface of the seal radially outward toward the edge of the face of the neck of a bottle. The sealing surface for seating on the face edge of a bottle neck is located on the side of the seal away from the base of the cap-like closure, whereby the seal has a projection, away from the base of the closure part, along its outer edge. This projection clasps around the outside of the bottle neck in the axial direction.

The recess in the seal on the side toward the base of the closure part makes it possible for the seal to lift from the face surface of a bottle neck in the event of overpressure so that there is a release of pressure and the bursting of the bottle is avoided. Outside of the recess, such lifting cannot take place, and since the material of the seal is compressible with respect to volume, these areas of the seal form a seat for the closure, which is important in particular in the case of a screw closure. By this means, defined compression forces are produced in the area of the seal where the recess is located. Thus the pressure at which the seal lifts from the bottle neck in the area of the recess is precisely defined independent of the magnitude of the force with which it is screwed on. Movements of the base area of the cap-like closure through arching upward as a result increases in pressure are not used in this closure.

In order to improve the seating effect of the seal in the case of this known closure, this seal has a ring-shaped area in which no compression of the seal can take place. This ring-shaped area is naturally in the area of the face edge of a bottle neck. Since this area is radially very small, it is difficult in practice to assure that the ring-shaped area seats on the bottle neck. As a result of this ring-shaped seating area, the area in which the seal can fit and can lift in the event of overpressure is very small. In practice, this results in sealing problems.

The task of the invention is to create a closure of the type indicated in the introductory clause of the claim in which the disadvantages of the known closure are avoided, i.e., in which in particular the seal effect is improved with relatively large tolerances of width of the face edge of a bottle neck and of the radial position of the same.

The task of this invention is solved through the principle indicated in the characteristic of the claim.

BRIEF SUMMARY OF THE INVENTION

The basic idea of this principle consists of creating a sloping, essentially cone-shaped sealing surface on the seal, which forms at least a part of the seal surface and which causes a centering of the seal and an improvement of the sealing effect. This is a result of the sloping surface seating at the outer border of the face edge of a bottle neck and causing an elevated surface compression there. This compression is reduced or eliminated if the base of the closure part arches outward upon overpressure, thereby creating the effect of an overpressure valve.

It is also advantageous for the sealing surface part to extend out over the outer border of the face surface of a bottle neck, whereby the blow-by pressure can be influenced by means of the dimensioning of the radial overhang. A relatively small overhang results in a small blow-by pressure, and relatively greater overhang in a larger blow-by pressure.

The angle of slope of the sealing surface part is advantageously selected such that its movement away from the edge of a bottle neck is greatest upon the arching of the base of the cap-like closure part. Through the degree of slope, it is possible to influence in an advantageous manner the pressure above which the sealing effect is reduced or disappears completely and thus the blowing off of overpressure occurs.

The radial elongation of the sloping sealing surface portion advantageously extends at least over the tolerance range of the radially outer border of the face surface of the neck of a bottle. By this means, the function of the sloped sealing surface portion is assured for all occurring radial dimensions of the outer border of the face surface of a bottle neck of bottles which are to be closed by the closure.

The sealing surface portion and the projection are advantageously provided on a seal arranged in the base of the cap-like closure part. The material of this seal can then be selected independent of that of the cap-like closure and thus can be adapted to the sealing conditions.

With the use of such a separate seal it is advantageous for it to have, on the side toward the base, at least one recess which extends from a radial area inside of the face surface of a bottle neck radially outward from the bottle. It is advantageous for the recess to extend into the outer surface of the projection. In the area of the recess, the seal can yield so that it can withdraw in the event of an overpressure and can support the blow-by process in the event of overpressure.

BRIEF DESCRIPTION OF THE DRAWING

With the aid the drawing, the invention is explained in greater detail based on an embodiment example.

DETAILED DESCRIPTION OF THE PRESENT INVENTION

Figure 1:
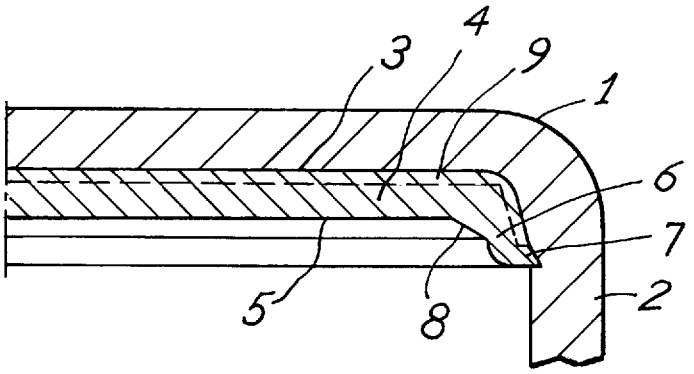
FIG. 1 is a half radial section through an embodiment example of the invention.

The closure presented in FIG. 1 halved and sectioned shows a cap-like closure part 1, the edge 2 of which is depicted only partially and which has, in the part not depicted, an inward-directed projection, such as by way of example a crimp of a crown or a thread of a metal or plastic screw closure, for clasping an outward-directed projection on the bottle neck. Opposite a base 3 of the closure part 1, a seal 4 is arranged which has a sealing surface 5 for seating on the face edge of a bottle neck.

The seal 4 has, along its outside edge, a projection 6 directed away from the base 3 of the closure part 1, which projection clasps around the outer edge of the bottle neck when screwed on. The projection 6 has a small extension 7 which engages toward the inside in a complementary groove in the edge 2 of the closure part 1 so that the seal 4 is securely united with the closure part 1.

The sealing surface 5 has a sealing surface part 8 on a radial inner surface of the projection 6. This sealing surface part slopes from the projection 6 toward the interior. This sloping, therefore cone-like, sealing surface part 8 of the projection 6, in screwed-on state, is seated firmly on the outer edge of the face surface of a bottle neck, thereby forming a good seal. Upon an increase of pressure in the bottle, the base 3 arches outward, causing the edge 2 in the area of sealing surface part 8 to move away from the face edge of the bottle upward and outward approximately perpendicular to itself, thus reducing or eliminating the sealing effect allowing overpressure to escape. The degree of slope of the sealing surface 3 determines in part the opening pressure of the overpressure valve formed by the closure.

On the side away from the sealing surface 5 and the sloping sealing surface part 8 and toward the base 3 of the closure part, the seal 4 has narrow radial channels 9. In the area of these channels 9, the seal 4 can yield toward the base 3 of the closure part 1 if the pressure is sufficiently high in the bottle.

By these means, an overpressure valve is formed which can be dimensioned such that bursting of a bottle is avoided.

In the embodiment example depicted, the channels 9 extend into the outer surface of the projection 6 so that the material of the projection can also yield, specifically in a radial direction toward the outside, if there is sufficiently high pressure.

Figure 2:
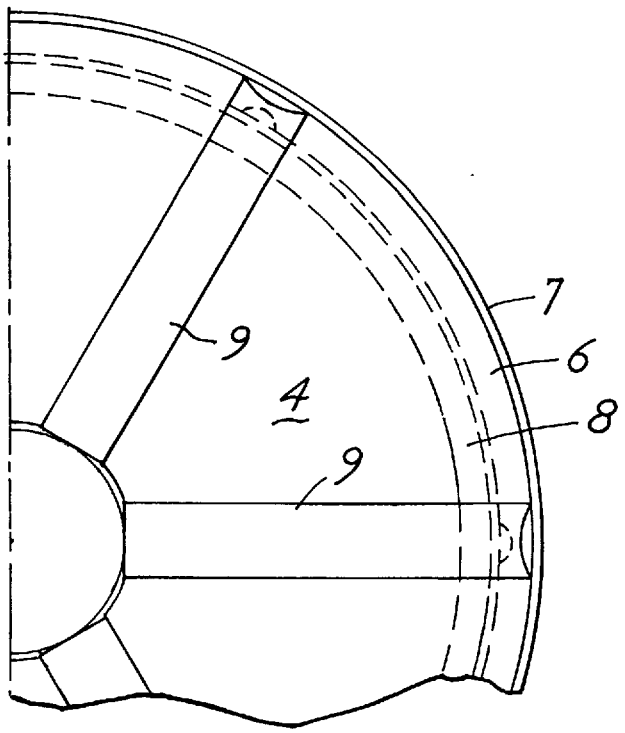
FIG. 2 in a plan view of the seal per FIG. 1.

FIG. 2 shows only a portion of the seal per FIG. 1, specifically from above in the drawing of FIG. 1, i.e., from the base 3 of the closure part 1. In this manner, the size and the course of the channels are clearly visible.

While we have shown a presently preferred embodiment of the present invention, it will be apparent to persons skilled in the art that the invention may be otherwise embodied within the scope of the following claims.

We claim:

1. A closure for a bottle having a neck with a face surface and a face edge thereon, said closure including a cap-like closure part which has, an edge, an inward-directed projection on said edge for clasping an outward-directed projection on the neck of the bottle and on the interior, in the area of the face edge of the bottle neck, a sealing surface for seating on the face surface of the bottle neck, characterized by the fact that the cap-like closure part has a base and the sealing surface (5) has a cone like sealing surface part (8) which is formed on the radial interior side of a projection directed axially away from the base (3) of the closure part (1), said sealing surface part clasping around the outside of the bottle neck and sloping radially to the inside and axially counter to the screwing direction.

2. A closure in accordance with claim 1 characterized by the fact that the slope of the sealing surface part (8) is selected such that its movement away from the edge of a bottle neck is greatest in the event of elevation of pressure and arching of the base (3) of the cap-like closure part (1).

3. A closure in accordance with claim 1 or 2 characterized by the fact that the slope of the sealing surface part (8) is dimensioned dependent upon the opening pressure, such that the opening pressure is lower with a smaller slope and greater with a larger slope.

4. A closure in accordance with claim 1 or 2 characterized by the fact that the sealing surface part (8) extends out over the exterior border of the face surface of the bottle neck, whereby the radial overhang is dimensioned dependent on the desired blow-by pressure such that the opening pressure is lower with a smaller overhang and greater with a larger overhang.

5. A closure in accordance with claim 1 or 2 characterized by the fact that the radial extension of the sloped sealing surface part (8) extends at least over the tolerance range of the radial exterior border of the face surface of the neck of the bottle.

6. A closure in accordance with claim 1 characterized by the fact that the sealing surface part (8) and the projection (6) are provided on a seal (4) arranged in the flow of the cap-like closure part (1).

7. A closure in accordance with claim 6 characterized by the fact that the seal (4) has, on its side directed toward its base (3), at least one recess (9) which extends from a radial area inside of the face surface of a bottle radially outward from the bottle.

8. A closure in accordance with claim 7 characterized by the fact that the recess (9) extends to the outer surface of the projection (6).

* * * * *